US006585346B2

(12) United States Patent
Endo

(10) Patent No.: US 6,585,346 B2
(45) Date of Patent: Jul. 1, 2003

(54) PRINTING APPARATUS WITH MISSING DOT TESTING

(75) Inventor: Hironori Endo, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 10/020,865

(22) Filed: Dec. 13, 2001

(65) Prior Publication Data

US 2002/0085057 A1 Jul. 4, 2002

(30) Foreign Application Priority Data

Dec. 25, 2000 (JP) ..... 2000-392196

(51) Int. Cl.[7] ..... B41J 29/393; B41J 29/38
(52) U.S. Cl. ..... 347/19; 347/14
(58) Field of Search ..... 347/19, 14, 23, 347/12, 10, 11, 15, 17, 16, 5, 8, 9, 41, 42, 43, 47

(56) References Cited

FOREIGN PATENT DOCUMENTS

| | | |
|---|---|---|
| EP | 0925929 A2 | 6/1999 |
| EP | 2000326524 | 11/2000 |
| EP | 1059170 A1 | 12/2000 |

*Primary Examiner*—Lamson Nguyen
*Assistant Examiner*—Charles W. Stewart, Jr.
(74) *Attorney, Agent, or Firm*—Beyer Weaver & Thomas, LLP

(57) ABSTRACT

The presence or absence of inoperative nozzles is detected by comparing a specific threshold with a time interval between successive detection pulses. The presence or absence of inoperative nozzles can thus be established without the use of information about the positional relation between the print head and the ink drop detection device, dispensing with the need to align the print head and the ink drop detection device with high accuracy.

21 Claims, 14 Drawing Sheets

Technique for detection of ink drops in air

Signal waveform
(No. 6 operating normally)

Enlarged diagram

Signal waveform
(No. 6 inoperative)

*Fig.12(a)*

Test results in the absence of missing dots

| Nozzle row | Black | Cyan | Light cyan | Magenta | Light magenta | Dark yellow |
|---|---|---|---|---|---|---|
| Number of nozzles subject to testing | 9 | 9 | 9 | 9 | 9 | 9 |
| Number of detected nozzles | 9 | 9 | 9 | 9 | 9 | 9 |
| Number of inoperative nozzle regions | 0 | 0 | 0 | 0 | 0 | 0 |

*Fig.12(b)*

Test results for a single missing dot (inoperative nozzle is at the midpoint of black nozzle row)

| Nozzle row | Black | Cyan | Light cyan | Magenta | Light magenta | Dark yellow |
|---|---|---|---|---|---|---|
| Number of nozzles subject to testing | 9 | 9 | 9 | 9 | 9 | 9 |
| Number of detected nozzles | 8 | 9 | 9 | 9 | 9 | 9 |
| Number of inoperative nozzle regions | 1 | 0 | 0 | 0 | 0 | 0 |

*Fig.12(c)*

Test results for a single missing dot (inoperative nozzle is an end nozzle of black nozzle row)

| Nozzle row | Black | Cyan | Light cyan | Magenta | Light magenta | Dark yellow |
|---|---|---|---|---|---|---|
| Number of nozzles subject to testing | 9 | 9 | 9 | 9 | 9 | 9 |
| Number of detected nozzles | 9 | 8 | 9 | 9 | 9 | 9 |
| Number of inoperative nozzle regions | 0 | 0 | 0 | 0 | 0 | 0 |

*Fig. 14(a)*

Accumulation result when solely nozzle No. 22 is inoperative

| Number of identifications of missing dots | First | Second | Third | Fourth | Fifth |
|---|---|---|---|---|---|
| Number of nozzles detected before identification of missing dots | 21 | | | | |
| Number of nozzles detected after identification of missing dots | 28 | | | | |
| Total number of detected nozzles | 49 | | | | |

*Fig. 14(b)*

Accumulation result when nozzle Nos. 22, 34, and 41 are inoperative

| Number of identifications of missing dots | First | Second | Third | Fourth | Fifth |
|---|---|---|---|---|---|
| Number of nozzles detected before identification of missing dots | 21 | 32 | 38 | | |
| Number of nozzles detected after identification of missing dots | 26 | 15 | 9 | | |
| Total number of detected nozzles | 47 | 47 | 47 | | |

*Fig. 14(c)*

Accumulation result when nozzle Nos. 22 and 23 are inoperative

| Number of identifications of missing dots | First | Second | Third | Fourth | Fifth |
|---|---|---|---|---|---|
| Number of nozzles detected before identification of missing dots | 21 | | | | |
| Number of nozzles detected after identification of missing dots | 27 | | | | |
| Total number of detected nozzles | 48 | | | | |

PRINTING APPARATUS WITH MISSING DOT TESTING

BACKGROUND OF THE INVENTION

1. Field of the Invention

The present invention relates to a technique for detecting the ejection of ink drops by a printing apparatus.

2. Description of the Related Art

In an ink-jet printer, ink drops are ejected from a plurality of nozzles to print images. The print head of an ink-jet printer is provided with a plurality of nozzles, some of which are occasionally plugged and rendered incapable of discharging ink drops because of an increase in ink viscosity, the entry of gas bubbles, and other factors. Nozzle plugging produces images with missing dots and has an adverse effect on image quality.

Optical detection devices have been proposed for detecting the ejection of ink drops. In such detection devices, the plurality of nozzles mounted on the print head are tested by the mutual movement of the print head and an ink drop detection device. According to these methods, the operating state of each nozzle is determined by a procedure in which the print head is moved, a nozzle is positioned at a specific point, and ink drops are ejected, blocking light from the detection device.

These methods are disadvantageous, however, in that the ink drop detection device and the print head nozzles must be aligned with high accuracy in the direction of main scanning.

SUMMARY OF THE INVENTION

Accordingly, an object of the present invention is to provide a technique for detecting presence of an inoperative nozzle while dispensing with the need to align the ink drop detection device and the print head nozzles with high accuracy.

In order to attain the above and the other objects of the present invention, there is provided a printing apparatus. The printing apparatus comprises a print head, an ink drop detector, a feed mechanism, a detection pulse analyzer, and a nozzle condition determiner. The print head includes a nozzle row having a plurality of nozzles for ejecting ink drops. The plurality of nozzles is aligned in a direction of sub-scanning. The ink drop detector has a light emitter for emitting light and a light receiver for receiving the light emitted by the light emitter. The ink drop detector is configured to generate detection pulses in response to blockage of the light by the ink drops. The feed mechanism is configured to move the print head and/or the ink drop detector in order for the print head and the ink drop detector to move relative to each other. The detection pulse analyzer is capable of: measuring a time interval of two consecutive detection pulses which are detected by the ink drop detector while the print head and the ink drop detector are relatively moving in a constant speed; judging that the two consecutive detection pulses are associated with a same nozzle if the time interval is less than a first threshold value, while judging that the two consecutive detection pulses are associated with two different nozzles if the time interval is greater than the first threshold value; and counting a number of operative nozzles capable of ejecting ink drops based on the judgment. The nozzle condition determiner is configured to determine presence of an inoperative nozzle incapable of ejecting ink drops if the number of operative nozzles is less than a number of test nozzles being subject to the ink drop detection.

In this printing apparatus, an inoperative nozzle can be detected by comparing a specific threshold with a time interval between successive detection pulses, thus making it possible to identify the inoperative nozzle while dispensing with the need to align the ink drop detection device and the print head nozzles with high accuracy.

In a preferred embodiment of the invention, the detection pulse analyzer judges that a missing dot region including at least one inoperative nozzle exists between the two different nozzles associated with the two consecutive detection pulses if the time interval is greater than a second threshold value which is greater than the first threshold value. The nozzle condition determiner further determines presence of an inoperative nozzle based on the judgment of the missing dot region.

The possibility of an inoperative nozzle being overlooked is reduced because the absence of dots is detected based on the logical sum of a detection result related to missing dots and a detection result obtained by determining whether the number of confirmed normally operative nozzles is less than the number of nozzles being tested.

In another preferred embodiment of the invention, the print head comprises a plurality of test nozzle rows. The test nozzle rows are subject to the ink drop detection during a single pass of relative movement of the print head and the ink drop detector. The detection pulse analyzer is capable of: (i) judging that the two consecutive detection pulses are associated with two different test nozzle rows if the time interval is greater than a third threshold which is greater than the second threshold value; (ii) counting a number of test nozzle rows based on the judgment of test nozzle row; (iii) counting a number of operative nozzles in each test nozzle row; and (iv) counting a number of missing dot regions in each test nozzle row. The nozzle condition determiner further determines presence of an inoperative nozzle in an individual test nozzle row if the number of operative nozzles in the test nozzle row is less than the number of test nozzles in the test nozzle row and/or if the missing dot region is detected in the test nozzle row.

Adopting this approach makes it possible, for example, to identify missing dots for each test nozzle rows on the basis of a logical sum of an estimate designed to determine the presence of an inoperative nozzle region and an estimate designed to determine whether the number of confirmed normally operative nozzles is less than the number of test nozzles when a plurality of nozzle rows are tested during a single main scan.

In other preferred embodiment of the invention, the detection pulse analyzer is further capable of: (i) counting a number of operative reference nozzles which are disposed at one of ends of each test nozzle row based on detection signals obtained while only the reference nozzles are ejecting ink drops; (ii) counting a number of operative intermediate nozzles and a number of intermediate missing dot regions, the operative intermediate nozzles and the intermediate missing dot regions being disposed between the reference nozzle and each missing dot regions in each test nozzle rows. The nozzle condition determiner is further capable of: (i) determining that all of the reference nozzles are operative nozzles if the number of operative reference nozzles matches a number of the reference nozzles; and (ii) determining a position of each inoperative nozzle included in each missing dot region in each test nozzle row based on the number of operative intermediate nozzles and the number of intermediate missing dot regions in each test nozzle rows.

Adopting this approach allows successful nozzle operation to be confirmed based on the ejection of ink solely from the end nozzles, making it possible to increase detection accuracy for the end nozzles, whose operation cannot be tested directly by missing dot identification.

In other preferred embodiment of the invention, the detection pulse analyzer counts a number of operative nozzles and a number of missing dot regions which are present before and after each missing dot region. The nozzle condition determiner determines a position of each inoperative nozzle included in each missing dot region based on the number of operative nozzles and the number of missing dot regions present before and after each missing dot regions.

With this approach, a plurality of nozzles are analyzed nozzle by nozzle to identify inoperative nozzles, making it possible, for example, to launch a complementary operating cycle in which dots are formed by alternative nozzles.

In other preferred embodiment of the invention, the feed mechanism is capable of moving the print head and/or the ink drop detector in order for the print head and the ink drop detector to move relative to each other a plurality of times. The plurality of nozzles are divided into a plurality of groups, a selected one of the plurality of groups being subject to testing during one pass of relative movement. The detection pulse analyzer counts a number of operative nozzles during each pass of relative movement. The nozzle condition determiner determines presence of an inoperative nozzle incapable of ejecting ink drops if the number of operative nozzles is less than a number of the test nozzles during each pass of relative movement.

Adopting this approach allows the distance between the nozzles being tested during each main scan to be appropriately increased, making it possible to efficiently prevent situations in which light is blocked by ink drops ejected by certain nozzles when other nozzles are being tested.

The present invention can be implemented as a method or device for detecting nozzle ejection, a computer program for allowing the functions of the method or device to be performed by a computer, a data signal implemented as part of a carrier wave and designed to contain this computer program, or the like.

These and other objects, features, aspects, and advantages of the present invention will become more apparent from the following detailed description of the preferred embodiments with the accompanying drawings.

BRIEF DESCRIPTION OF THE DRAWING

FIGS. 12(*a*)-12(*c*) are tables with examples of results obtained by accumulating test cycles in accordance with the first embodiment of the present invention;

FIGS. 14(*a*)-14(*c*) are tables with examples of results obtained by accumulating test cycles in accordance with the second embodiment of the present invention.

DESCRIPTION OF THE PREFERRED EMBODIMENT

Embodiments of the present invention will now be described through embodiment in accordance with the following sequence.

Figure 1:
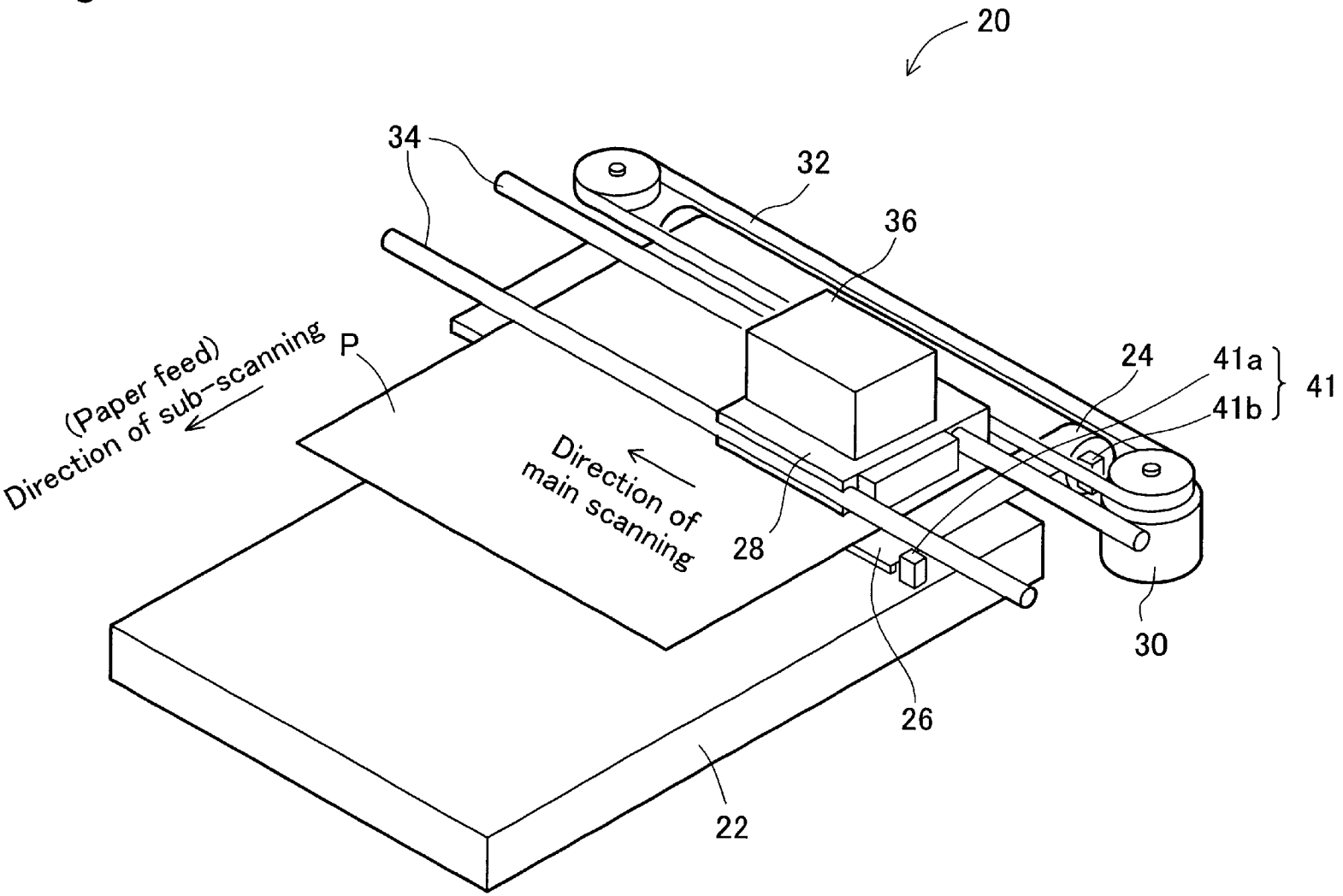
FIG. 1 is a schematic perspective view depicting the structure of the principal components constituting a color ink-jet printer 20 as an embodiment of the present invention.

A. Apparatus Structure
B. Structure and Operating Principle of Ink Drop Detector
C. First Embodiment
D. Second Embodiment
E. Modifications A. Apparatus Structure FIG. 1 is a schematic perspective view depicting the structure of the principal components constituting a color ink-jet printer 20 as an embodiment of the present invention. The printer 20 comprises a paper stacker 22, a paper feed roller 24 driven by a step motor (not shown), a platen plate 26, a carriage 28, a step motor 30, a traction belt 32 driven by the step motor 30, and guide rails 34 for the carriage 28. A print head 36 provided with numerous nozzles is mounted on the carriage 28. The step motor 30 is also referred to as a "carriage motor."

An ink drop detector 41 is mounted in a standby position of the carriage 28 on the right side in FIG. 1. The ink drop detector 41, which comprises a light emitter 41*a* and a light receiver 41*b*, tests the movement of ink drops through the air with the aid of light. Following is a detailed description of the manner in which the drops are tested by the ink drop detector 41.

Printing paper P is fed from the paper stacker 22 by the paper feed roller 24 and transported in the direction of sub-scanning across the surface of the platen plate 26. The carriage 28 is pulled by the traction belt 32, which is itself driven by the step motor 30, and is propelled along the guide rails 34 in the direction of main scanning.

Figure 2:
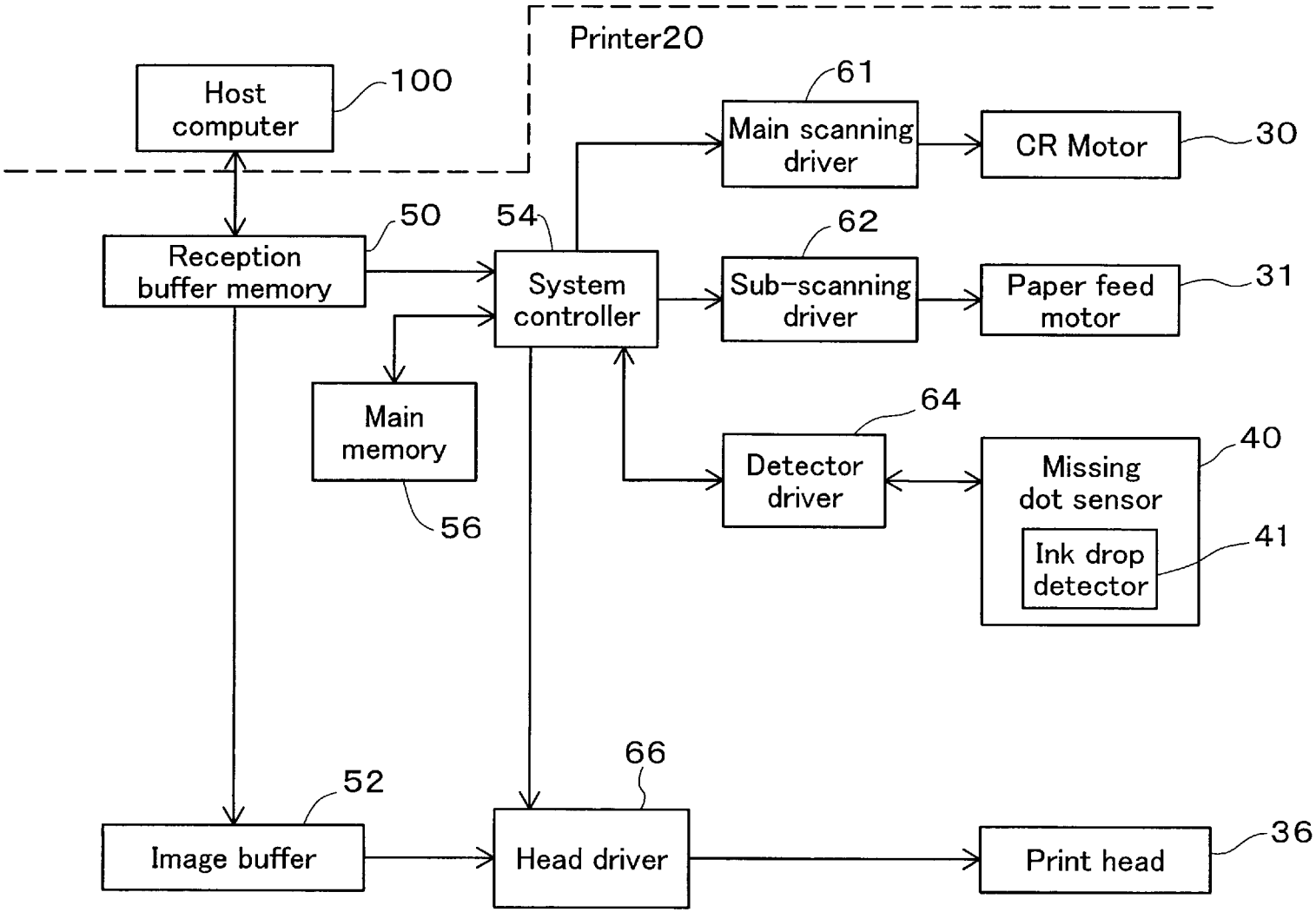
FIG. 2 is a block diagram depicting the electrical structure of the printer 20.

FIG. 2 is a block diagram depicting the electrical structure of the printer 20. The printer 20 comprises a reception buffer memory 50 for receiving signals from a host computer 100, an image buffer 52 for storing print data, a system controller 54 for controlling the operation of the entire printer 20, and a main memory 56. The following drivers are connected to the system controller 54: a main scanning driver 61 for driving the carriage motor 30, a sub-scanning driver 62 for driving a paper feed motor 31, a sensor driver 64 for driving a missing dot sensor 40 equipped with an ink drop detector 41, and a head driver 66 for driving the print head 36.

The printer driver (not shown) of the host computer 100 establishes various parametric values for defining the printing operation on the basis of the printing mode (high-speed printing mode, high-quality printing mode, or the like) specified by the user. Based on these parametric values, the printer driver generates print data for performing printing according to the specified printing mode and forwards these data to the printer 20. The data thus forwarded are temporarily stored in the reception buffer memory 50. In the printer 20, the system controller 54 reads the necessary information from among the print data presented by the reception buffer memory 50 and sends a control signal to each driver on the basis of this information.

The image buffer 52 stores print data for a plurality of color components. To obtain these data, the print data received by the reception buffer memory 50 are resolved for each color component. With the head driver 66, the print data for each color component from the image buffer 52 are read in accordance with the control signal from the system controller 54, and the nozzle array of each color provided to the print head 36 is driven in accordance with the result.

The system controller 54 performs various functions through the agency of the computer programs stored in the main memory 56, including the missing dot testing function and adjustment function of the missing dot sensor 40.

The computer program for performing the functions of the system controller 54 can be stored on a computer-readable storage medium such as a floppy disk or CD-ROM. The host computer 100 reads the computer program from the storage medium and forwards the program to the main memory 56 of the printer 20.

The storage medium used in the present invention may be a floppy disk, a CD-ROM, a magneto-optical disk, an IC card, a ROM cartridge, a punch card, printed matter with bar codes or other printed symbols, an internal computer storage device (RAM, ROM, or another type of memory), an external storage device, or another computer-readable medium.

B. Structure and Operating Principle of Ink Drop Detector

Figure 3:
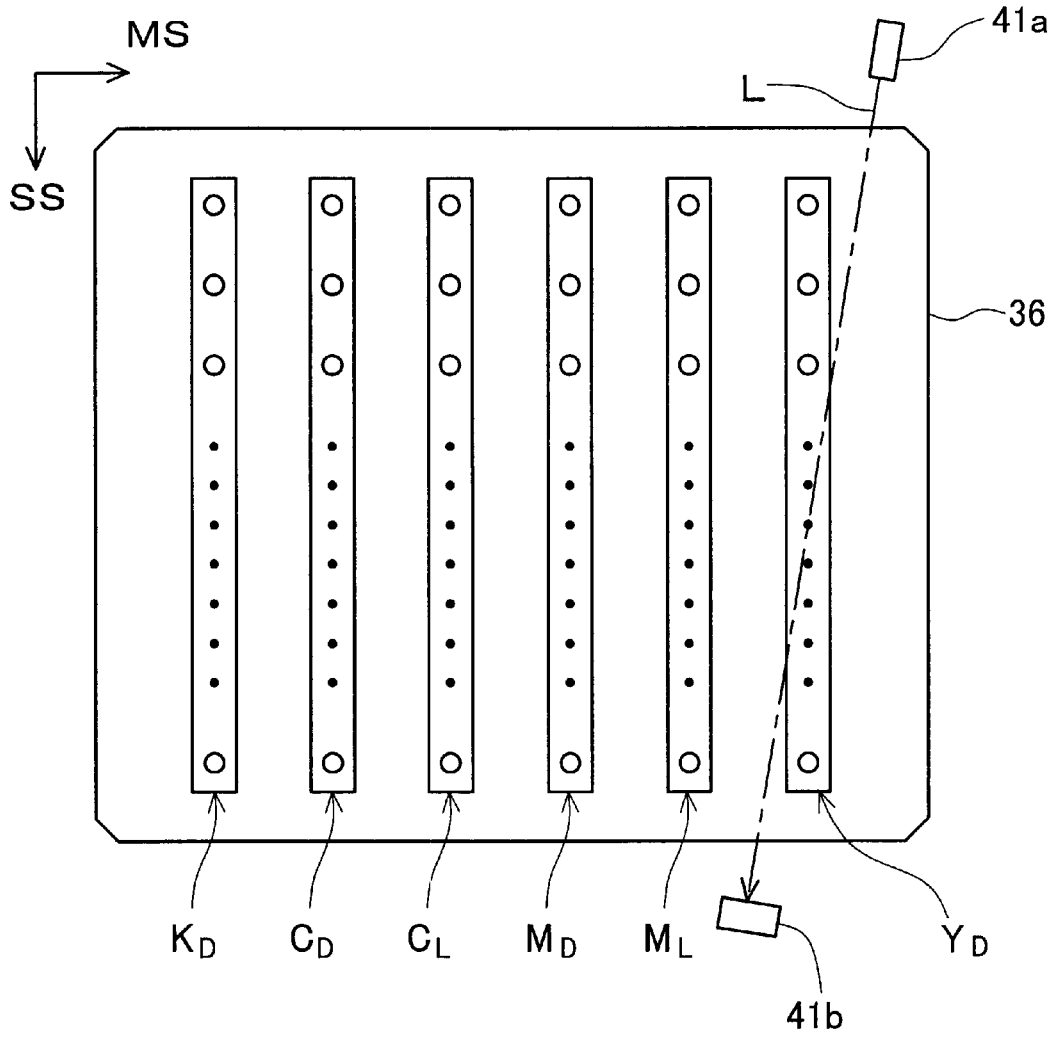
FIG. 3 is a diagram depicting the structure of the ink drop detector 41 and the operating principle of the testing method (technique for testing the movement of drops through the air)

FIG. 3 is a diagram depicting the structure of the ink drop detector 41 and the operating principle of the testing method (technique for detection of ink drops in the air). FIG. 3, which is a view of the print head 36 from below, depicts the six-color nozzle array (also referred to as "nozzle rows") of the print head 36, and the light emitter 41*a* and light receiver 41*b* of the ink drop detector 41.

The bottom surface of the print head 36 is provided with a black ink nozzle array $K_D$ for ejecting black ink, a dark cyan ink nozzle array $C_D$ for ejecting dark cyan ink, a light cyan ink nozzle array $C_L$ for ejecting light cyan ink, a dark magenta ink nozzle array $M_D$ for ejecting dark magenta ink, a light magenta ink nozzle array $M_L$ for ejecting light magenta ink, and a dark yellow ink nozzle array $Y_D$ for ejecting dark yellow ink.

The first capital letter in the symbol designating each nozzle array refers to the ink color, with the subscript "D" designating a comparatively dense ink, and the subscript "L" designating a comparatively light ink.

The nozzles of each of the plurality of nozzle arrays are aligned in the direction of sub-scanning SS. During printing, ink drops are ejected by the nozzles while the print head 36 moves together with the carriage 28 (FIG. 1) in the direction of main scanning MS.

The light emitter 41*a* is a laser diode for emitting a light beam L with an outside diameter of about 1 mm or less. The orientation of the light emitter 41*a* and light receiver 41*b* can be adjusted such that the direction of propagation of laser light L is somewhat inclined relative to the direction of sub-scanning SS. The manner in which this angle is set will be described below.

Missing dots are detected by a method in which the print head 36 is slowly moved in the direction of main scanning at a constant speed while laser light L is emitted, the nozzles being tested are sequentially actuated, and ink drops are ejected. An advantage of this method is that nozzle clogging is detected when ink drops ejected by certain nozzles deviate somewhat from their prescribed position or direction.

C. First Embodiment

Figure 4:
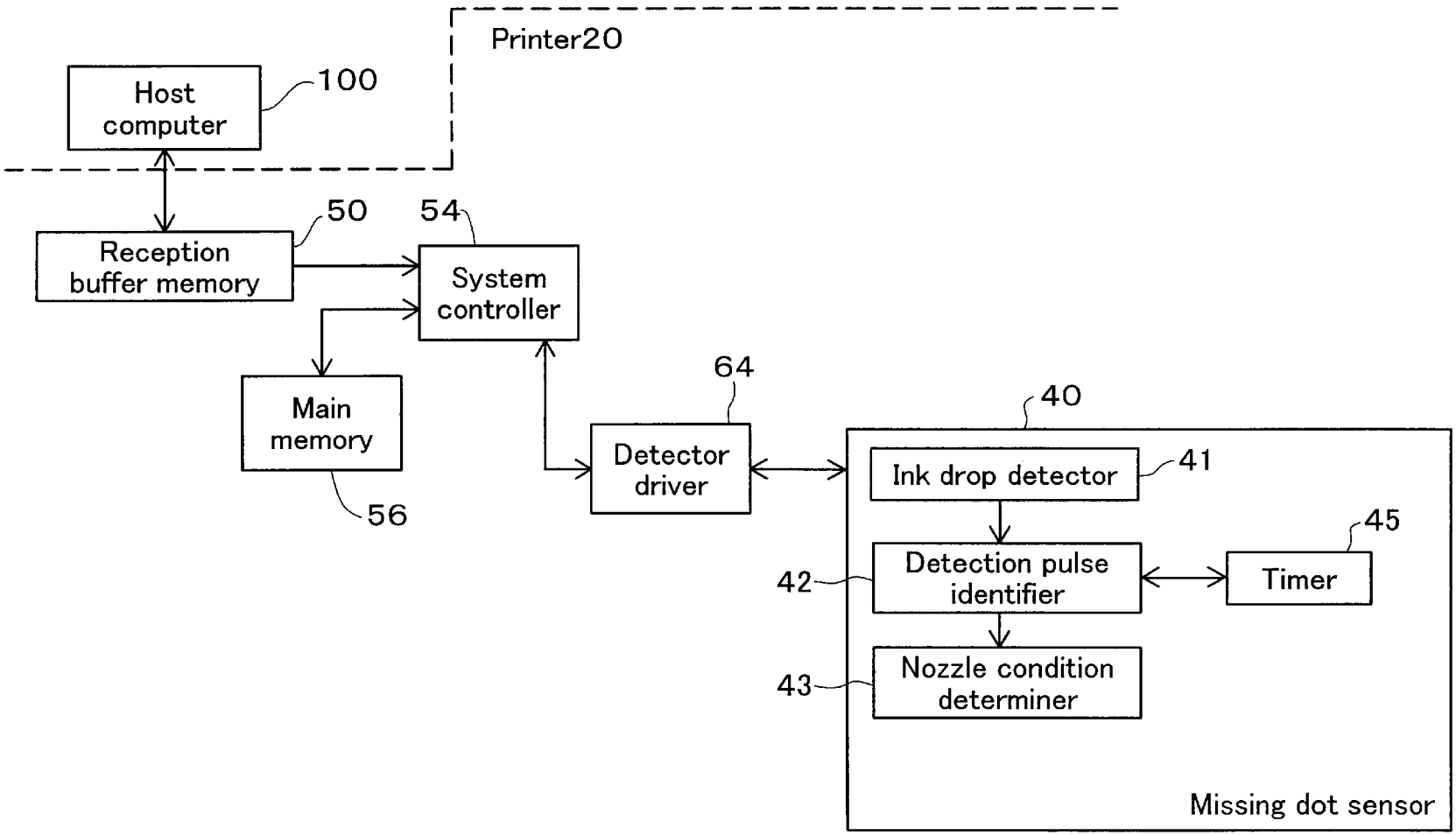
FIG. 4 is a block diagram depicting the electrical structure of the missing dot sensor.

FIG. 4 is a block diagram depicting the electrical structure of the missing dot sensor. The missing dot sensor 40 comprises an ink drop detector 41 for generating detection pulses in response to the blockage of laser light L by ink drops; a detection pulse analyzer 42 whereby the time interval between the detection pulses is compared with a predetermined specific threshold (see below), a specific type of analysis is carried out, and the results are counted forward; and a nozzle condition determiner 43 for identifying the clogging (dot loss) of a nozzle on the basis of the accumulated results of counting and analysis.

A timer 45 is connected to the detection pulse analyzer 42. The detection pulse analyzer 42 relies on the timer 45 to measure the time interval between the pulses generated by the ink drop detector 41.

Figures 5A, 5B, 5C:
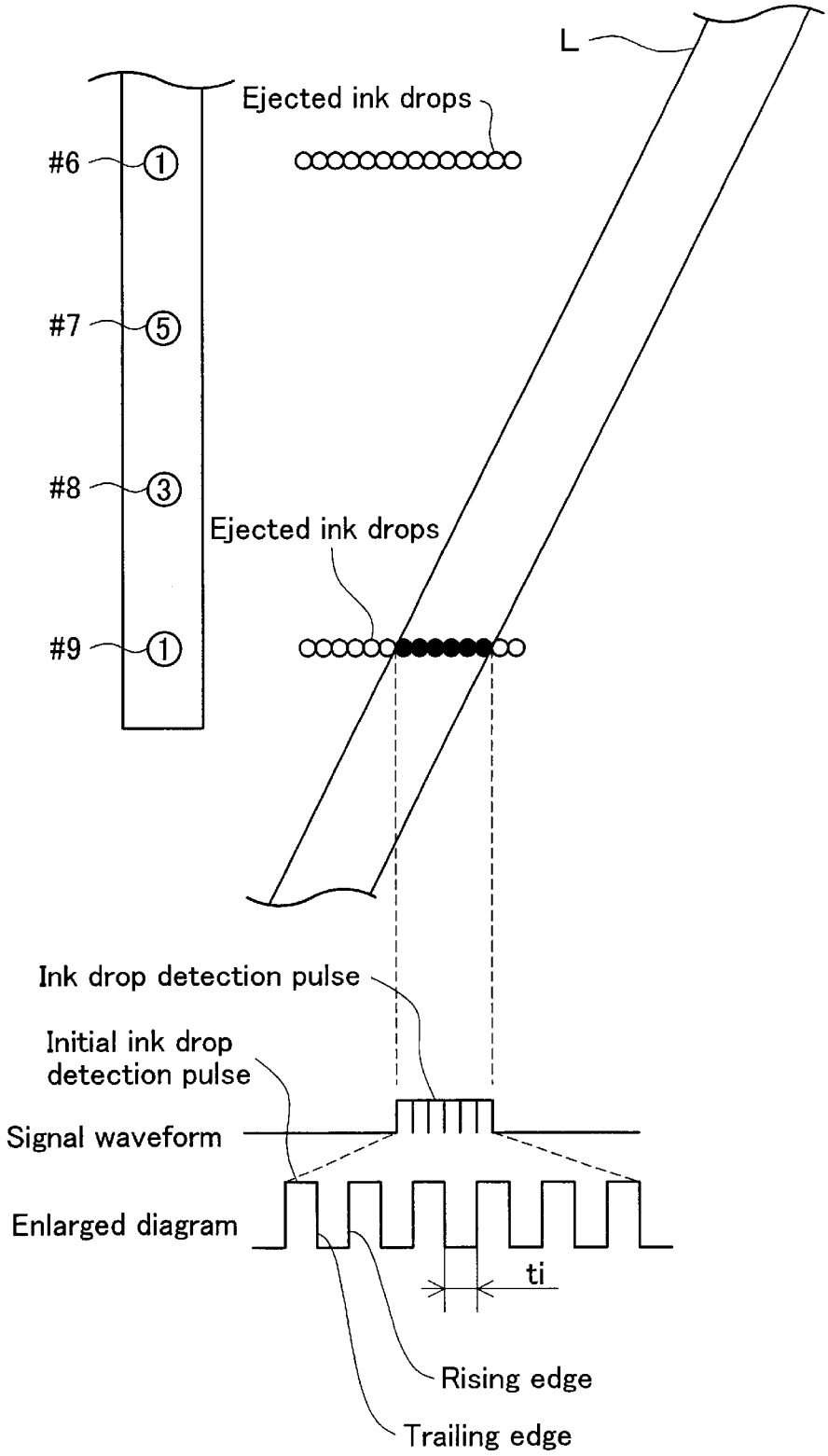
FIGS. 5(*a*)-5(*c*) are diagrams depicting ink drops ejected into the beam of laser light L, and the signal waveforms used to detect these drops.
Figure 6A:
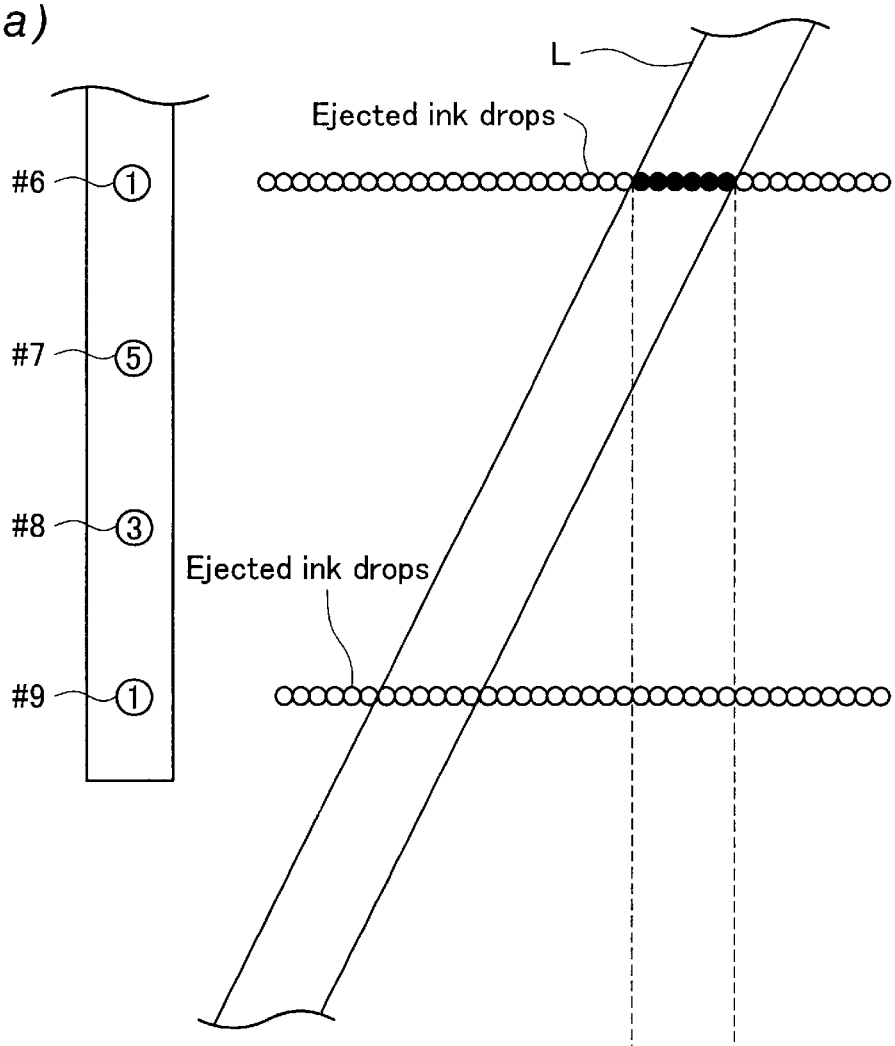
FIGS. 6(*a*)-6(*d*) are diagrams depicting ink drops ejected into the beam of laser light L, and the signal waveforms used to detect these drops.
Figure 6B:
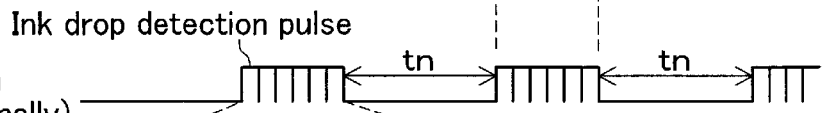
Figure 6C:
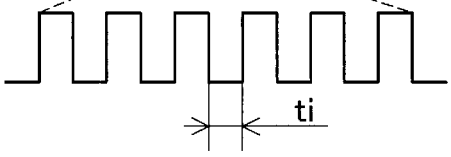
Figure 6D:
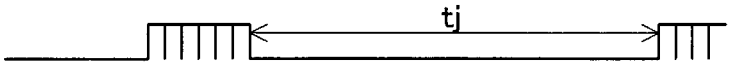

FIGS. 5(*a*)-5(*c*) and 6(*a*)-6(*c*) are diagrams depicting ink drops ejected inside a beam of laser light L, and signal wavelengths for detecting these drops. A single nozzle row is depicted on the left side in FIG. 5(*a*), and the beam of laser light L is depicted on the right side, as are the ink drops ejected by this nozzle row. For the sake of simplicity, a print head 36*a* (described in detail below) having six nozzle rows, with nine nozzles per row, is used herein instead of the print head 36 having 48 nozzles in each of its six nozzle rows. Each nozzle row of the print head 36*a* has nine nozzles. Of the nine nozzles, only nozzle Nos. 3 (not shown), 6, and 9, which have been selected as objects of testing, eject ink drops.

FIGS. 5(*b*) and 5(*c*) depict the waveforms of ink drop detection pulses generated by the ink drop detector 41 in response to the blockage of laser light L by ink drops. In the state shown in FIGS. 5(*a*)-5(*c*), ink drops ejected by nozzle No. 9 block laser light L. Six ejected ink drops block laser light L, and six ink drop detection pulses are generated in accordance with this blockage, as shown in FIG. 5(*b*). FIG. 5(*c*) shows in enlarged form the waveforms depicted in FIG. 5(*b*). It can be seen in the drawing that a plurality of ink drop detection pulses related to the same nozzle are generated during the short time intervals ti that conform to the cyclicity of ink ejection.

FIGS. 6(*a*)-6(*c*) depict the state established after a short time has elapsed following the condition shown in FIGS. 5(*a*)-5(*c*). In the state shown in FIGS. 6(*a*)-6(*c*), ink drops ejected by nozzle No. 6 block the laser light L. The leading edge of the first detection pulse produced by an ink drop ejected by nozzle No. 6 is detected when time tn has elapsed following the trailing edge of the last detection pulse produced by nozzle No. 9. The time tn is the time interval between the ink drop detection pulses generated in response to the ejection of ink drops by different test nozzles. The time tn can be arbitrarily set by selecting the nozzles for ejecting ink drops as test objects. In this example, nozzle Nos. 7 and 8 are removed from the testing list, and nozzle No. 6 is selected as the nozzle that is adjacent to nozzle No. 9 and is designated for testing. The time tn can thus be set much greater than time ti, which is the time interval between detection pulses generated in accordance with the ejection of ink drops by the same nozzle, making it possible to distinguish ink drops ejected by one nozzle from the ink drops ejected by another nozzle. Following is a detailed description of a method for selecting the nozzle to be tested.

Figures 7A, 7B:
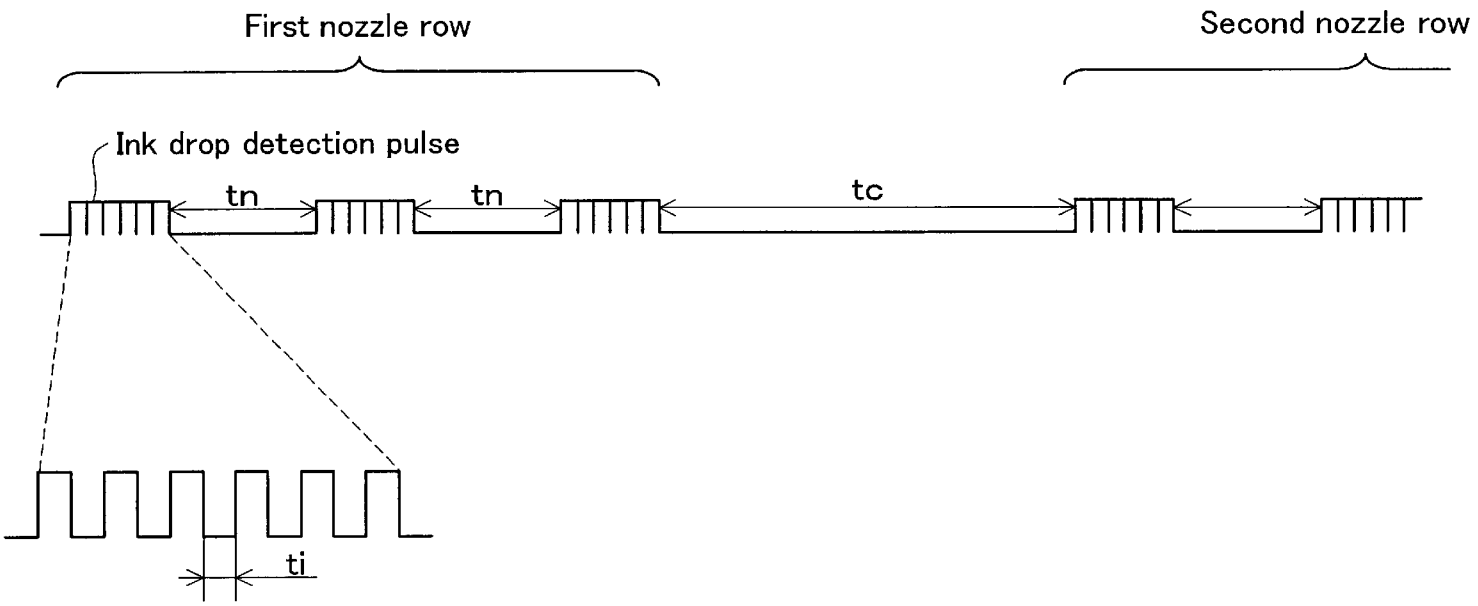
FIGS. 7(*a*) and 7(*b*) are diagrams depicting detection signal waveforms for testing of a plurality of nozzle rows.

FIGS. 7(*a*) and 7(*b*) are diagrams depicting detection signal waveforms for testing of a plurality of nozzle rows. The signal waveform shown in FIG. 7(*a*) also contains a waveform obtained after a short time has elapsed following the condition shown in FIG. 6(*b*). FIG. 7(*b*) shows in enlarged form the signal waveform depicted in FIG. 7(*a*). The time tc shown in the drawing is the time needed for laser light L to move between nozzle rows. In addition, time ti is the time interval between the detection pulses generated in response to the ejection of ink drops by the same nozzle, as described above. The time tn is the time interval between the ink drop detection pulses generated in response to the generation of ink drops by different test nozzles in the same nozzle row. The times tn and tc can be set by selecting the test nozzles and test nozzle rows. The setting procedure will be described in detail below.

Figure 8:
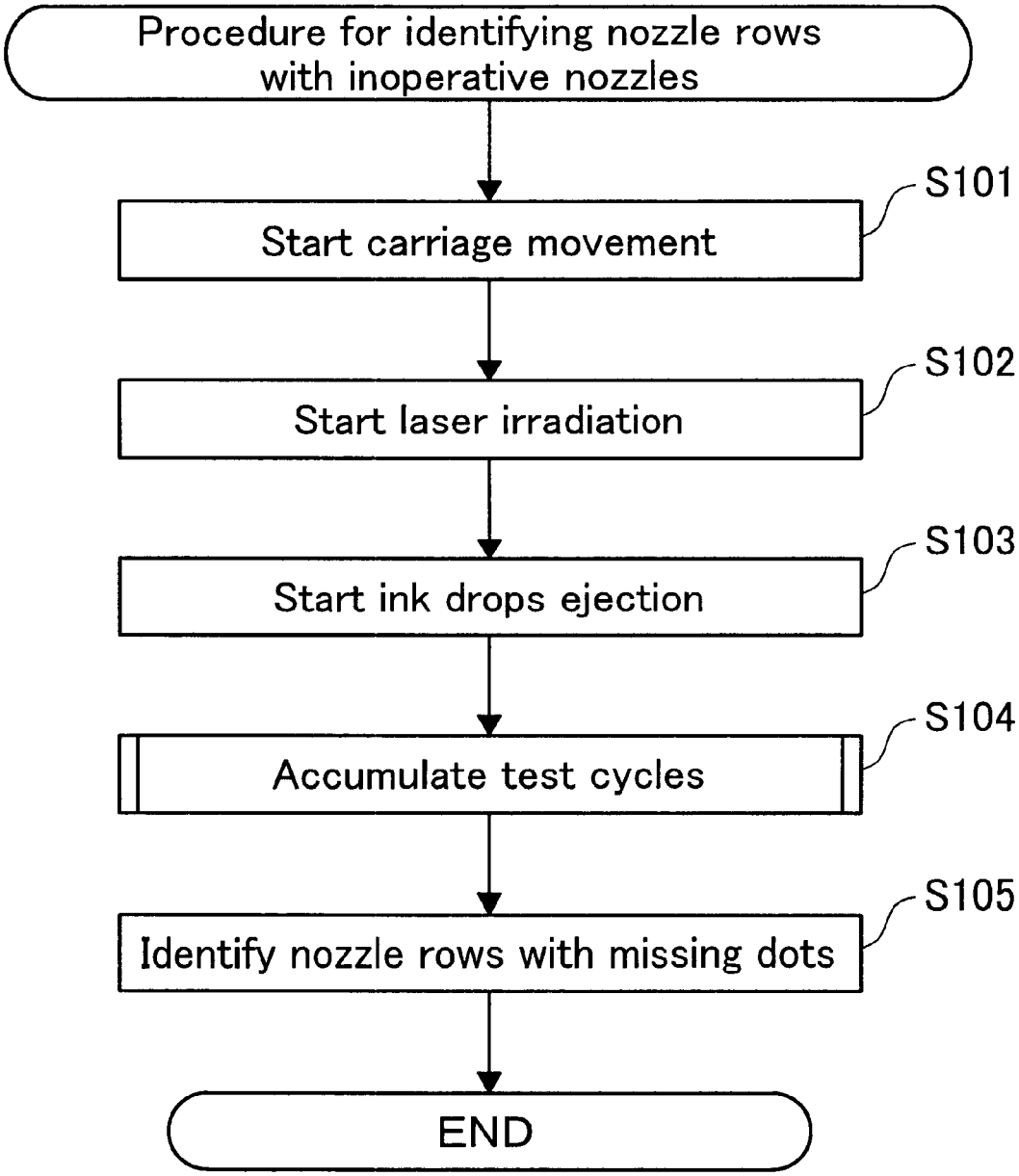
FIG. 8 is a flowchart depicting a procedure for identifying nozzle rows with inoperative nozzles.

FIG. 8 is a flowchart depicting a procedure for identifying nozzle rows with inoperative nozzles. According to this procedure, specifying the nozzle row containing an inoperative nozzle is used instead of specifying the inoperative nozzle by analyzing individual nozzles. Specifying nozzle rows containing inoperative nozzles is advantageous for cleaning nozzles on a row-by-row basis.

Upon receipt of a command from the system controller 54, the main scanning driver 61 actuates the carriage motor 30 and starts the main scanning of the carriage 28 in step S101. According to the missing dot testing procedure of the present embodiment, the print head 36 and the ink drop detector 41 are caused to move relative to each other as a result of the fact that the carriage 28 mounted on the print head 36 is caused to move in the direction of main scanning. Laser irradiation is started in step S102. The laser irradiation may, for example, be started with a timing that allows ink drops to be stably detected when at least one nozzle of the print head 36 reaches the vicinity of laser light L.

In step S103, the plurality of nozzles being tested start ejecting ink drops. For the sake of simplicity, it is assumed with reference to the embodiments of the present invention that ink drops are constantly ejected from a plurality of nozzles when laser irradiation is performed. It should be noted, however, that the ink drops may also be ejected when the nozzles being tested reach the vicinity of laser light L, and any method may be used as long as the drops can be ejected in this manner. After the initial ink ejection, the beam of laser light L enters the area in which ink drops are ejected by the nozzles of the print head 36. The ink drop detector starts generating detection pulses.

In step S104, the detection pulse analyzer 42 analyzes the detection pulse in each cycle and accumulates results of the analysis. The determination process is carried out by a procedure in which the time interval between the detection pulses generated by the ink drop detector 41 is compared with a predetermined threshold. The threshold will be described below.

Figure 9:
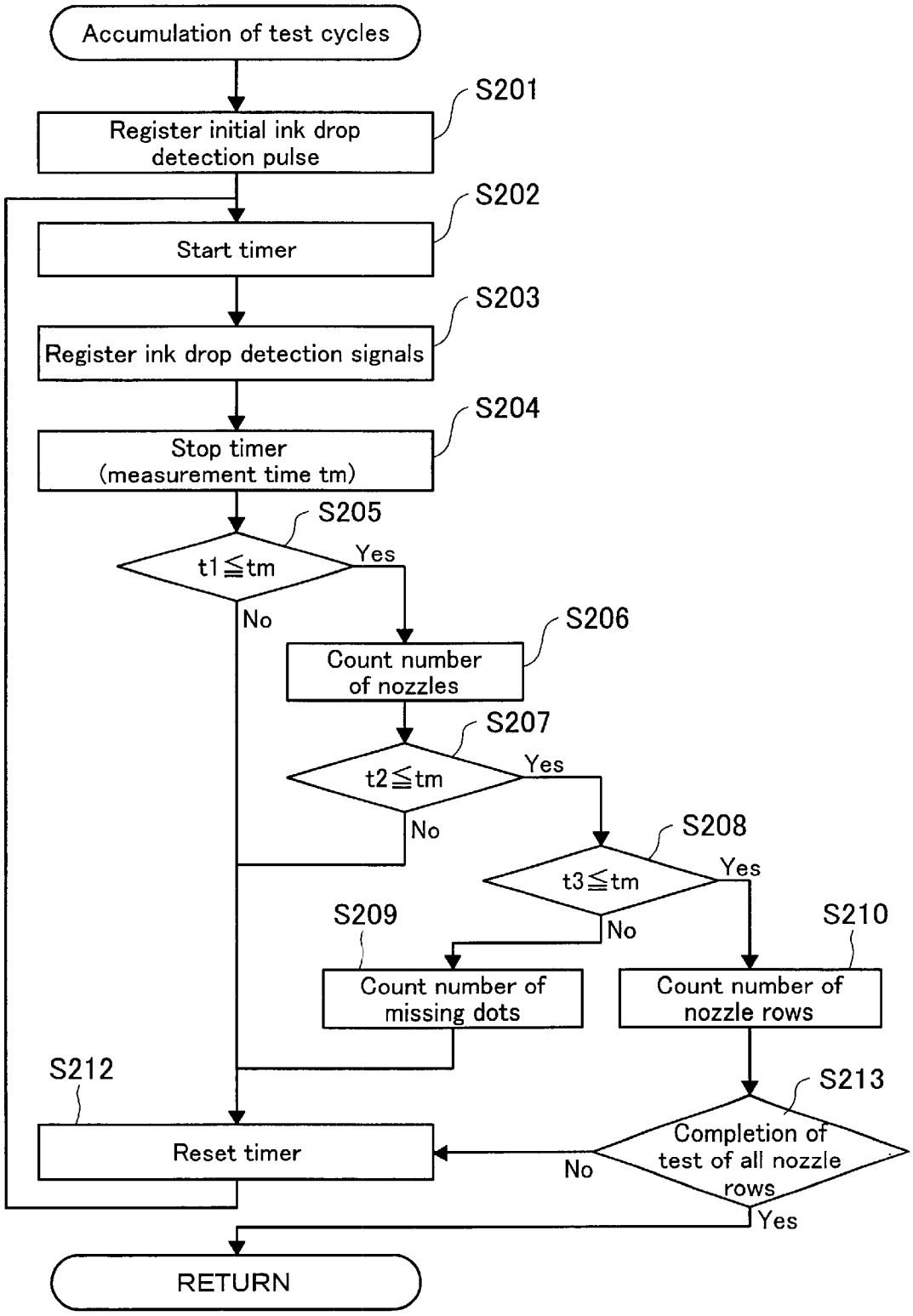
FIG. 9 is a flowchart depicting the procedure for accumulating test cycles in accordance with the first embodiment of the present invention.

FIG. 9 is a flowchart depicting the detailed procedure of step S104 in the first embodiment of the present invention. In step S201, the ink drop detector 41 generates a first ink drop detection pulse in accordance with the first blockage of laser light L by ink drops. The detection pulse is transmitted from the ink drop detector 41 to the detection pulse analyzer 42 (FIG. 4). In step S202, the detection pulse analyzer 42 actuates the timer 45 in response to the trailing edge (FIGS. 5(*a*)-5(*c*)) of this ink drop detection pulse. The initial measurement of the time interval between detection pulses is thus started.

In step S203, the ink drop detector 41 generates the next ink drop detection pulse in accordance with a new instance in which laser light L is blocked by ink drops. Upon receipt of this detection pulse, the detection pulse analyzer 42 stops the timer 45 in accordance with the rising edge of the ink drop detection pulse. The time ti between the trailing edge of the initial detection pulse and the rising edge (FIGS. 5(*a*)-5(*c*)) of the next detection pulse can thus be measured. Time ti is the time interval between detection pulses generated in accordance with the ejection of ink drops by the same nozzle. In the present specification, the actual measurement obtained by the timer is labeled tm.

In this example, the detection pulse analyzer 42 starts the timer by the trailing edge of a detection pulse and stops the timer by the rising edge of the detection pulse. This is not the only possible option, however, and any timing can be adopted as long as the time interval between sequential detection pulses can be measured. For example, the timer can be started and stopped by the rising edge of a detection pulse.

In step S205, the detection pulse analyzer 42 determines as the first step whether the measured time tm exceeds the first threshold t1. The first threshold t1 is a time that serves as a basis for determining whether the sequential detection pulses are generated in response to the ejection of ink drops by the same nozzle or different nozzles. The first threshold t1 is set at a level much above the time ti between the detection pulses originating in the same nozzle but far below the time tn between the detection pulses originating in different nozzles.

If the measured time tm is less than the first threshold t1, the detection pulse analyzer 42 concludes that the sequential detection pulses are from the same nozzle and proceeds to step S212. In step S212, the timer is reset and then restarted by the trailing edge of the detection pulse (step S202). If the measured time tm is greater than the first threshold t1, on the other hand, the detection pulse analyzer 42 concludes that the detection pulse is created by the ink ejected by a different nozzle and proceeds to step S206.

In step S206, the detection results are counted forward by the detection pulse analyzer 42. Since the number of such forward counts is obtained by concluding that the sequential detection pulses are produced by different nozzles, the result corresponds to a number that is one less than the number of normally operative nozzles being tested. For example, two different normally operative nozzles are detected when the number of forward counts in step S206 is equal to one.

In step S207, the detection pulse analyzer 42 determines as the second step whether the measured time tm exceeds the second threshold t2. The second threshold t2 is set at a level much above the time interval tn (FIGS. 7(*a*) and 7(*b*)) between the different nozzles of the same nozzle row, but far below the time interval tc between the nozzles of different nozzle rows. If the measured time tm is less than the second threshold t2, the detection pulse analyzer 42 concludes that the space between the two test nozzles is devoid of an inoperative nozzle region and proceeds to step S212. As used herein, the term "inoperative nozzle region" refers to a region in which the nozzles being tested are inoperative nozzles. The operation proceeds to step S208 if the measured time tm is greater than the second threshold t2. In this case, the time space between two detection pulses contains either a time corresponding to an inoperative nozzle region or an interval between two nozzle rows.

In step S208, the detection pulse analyzer 42 determines as the third step whether the measured time tm is greater than the third threshold t3. The third threshold t3 is designed to show whether the nozzle rows of the test nozzles have changed. This operation is also called nozzle row identification. In other words, the threshold t3 is the time that serves as a basis for determining whether the sequential detection pulses are generated in accordance with the ejection of ink drops ejected by the nozzles belonging to the same nozzle row or different nozzle rows. The third threshold t3 is set at a level far below the time tc (FIGS. 7(*a*) and 7(*b*)).

If the measured time tm is less than the third threshold t3, the detection pulse analyzer 42 concludes that the sequential detection pulses have originated in the same nozzle row and that this nozzle row contains an inoperative nozzle region. This determination operation is referred to as "missing dot identification." If the measured time tm is greater than the third threshold t3, the detection pulse analyzer 42 concludes that the sequential detection pulses have originated in nozzles belonging to different nozzle rows. This determination operation is referred to as "nozzle row identification."

In step S209, instances in which an inoperative nozzle region is concluded to be present are counted forward by the detection pulse analyzer 42. It should be noted, however, that since this type of determination makes it possible to detect the number of regions containing missing dots (inoperative nozzles), the number of inoperative nozzles cannot be directly calculated based on the detection results if plural consecutive nozzles tested are inoperative.

In step S210, instances in which a conclusion is made about a shift to other nozzle rows are counted forward by the detection pulse analyzer 42. Since such instances result from concluding that the detection pulses are produced by different nozzle rows, the result corresponds to a number that is one less than the number of detected nozzle rows.

In step S210, the missing dot sensor 40 operates such that the number of normally operative nozzles counted forward in step S206 is stored in the main memory 56 (FIG. 4) as normally operated test nozzles belonging to a corresponding nozzle row. This procedure is carried out through the agency of a detector driver 64 and a detection pulse analyzer 54. Once it is confirmed that the storage operation is concluded, the detection pulse analyzer 42 resets the result of counting of the nozzle number in order to allow the number of nozzles in the next nozzle row to be counted forward. The normally operative test nozzles of each nozzle row can thus be counted forward.

In step S213, the detection pulse analyzer 42 compares the number of detected nozzle rows and the number of nozzle rows designated for testing. If the number of detected nozzle rows is less than the number of nozzle rows designated for testing, the operation proceeds to step S212. In step S212, the timer is reset, and the operation returns to step S202. In step S202, the timer is restarted by the trailing edge of the detection pulse. When in step S213 the number of test nozzle rows matches the number of nozzle rows designated for testing, it is concluded that the last nozzle row designated for testing during the corresponding main scan is being tested. For the last test nozzle row, the detection pulse analyzer 42 terminates the process once the measured time tm exceeds the third threshold t3, without waiting for a subsequent detection pulse. The operation then proceeds to step S105 (FIG. 8).

Figure 10:
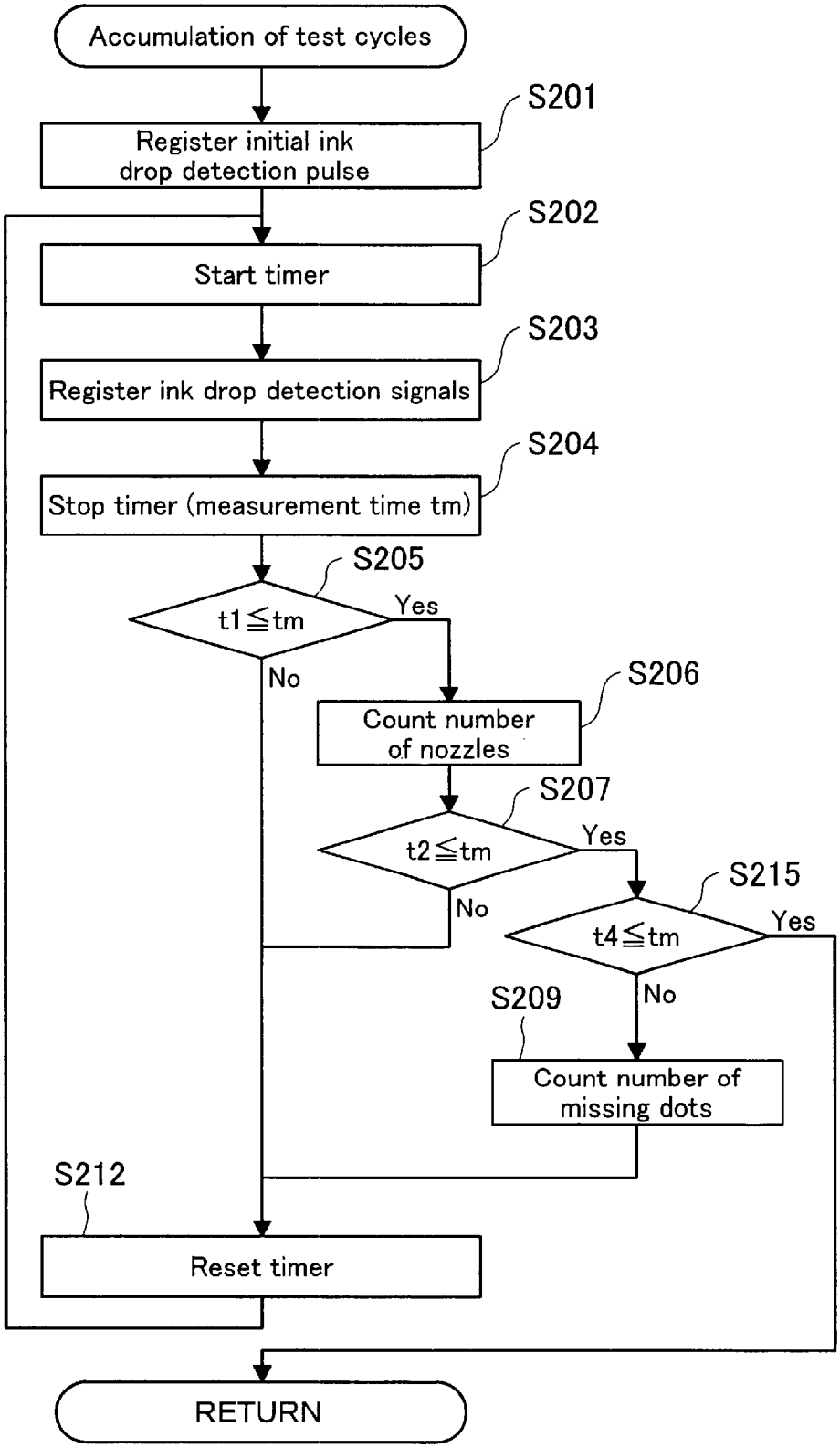
FIG. 10 is a flowchart depicting the procedure for accumulating test cycles in accordance with the second embodiment of the present invention.

FIG. 10 is a flowchart depicting another example of the detailed procedure of step S104. This procedure differs from the procedure shown in FIG. 9 in that only one nozzle row is designated to be tested for missing dots during a single main scan. As a result, it is unnecessary to determine whether a switch to another nozzle row has been made during the main scan. The step S210 for counting the nozzle rows is therefore omitted from the flowchart shown in FIG. 9.

In addition, the step S208 for determining whether a switch has been made to another nozzle row in the procedure shown in FIG. 9 is replaced with step S215 for determining whether the detection procedure has been completed. The determination entails finding out whether the measured time tm exceeds a fourth threshold t4. The fourth threshold t4 is set as a period sufficient for concluding that all the nozzles designated for testing have been passed over during the corresponding main scan.

Detection results pertaining to all the nozzles can be obtained by adopting an approach in which the procedure for accumulating the test cycles shown in FIG. 9 is repeated (that is, the main scan is repeated) for each of the plurality of groups into which the nozzles being tested are divided. The reasons for dividing the nozzles into a plurality of groups are described below.

Figure 11:
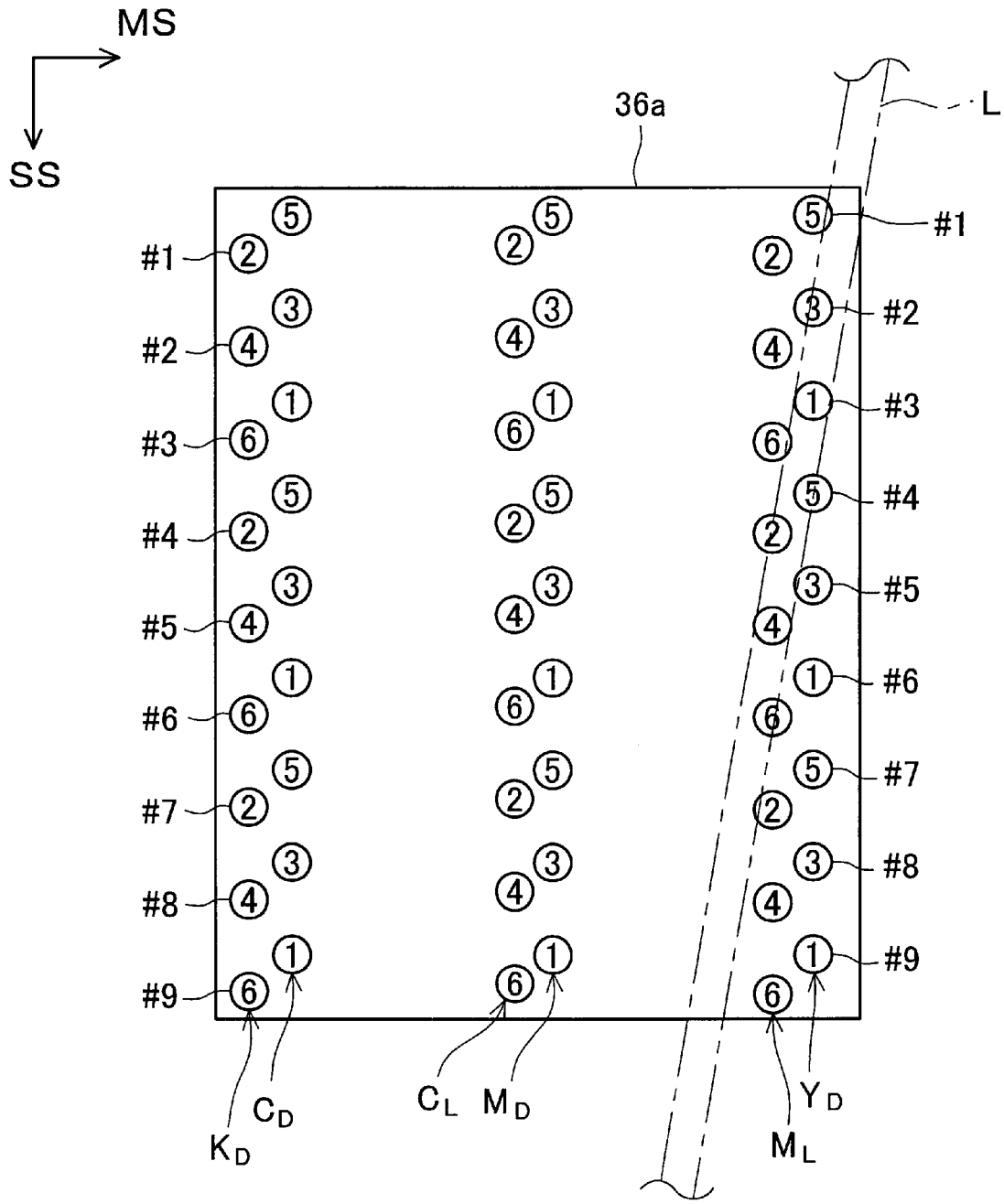
FIG. 11 is a diagram depicting the manner in which nozzles are divided into groups in accordance with an embodiment of the present invention.

FIG. 11 is a diagram depicting the manner in which nozzles are divided into groups in accordance with an embodiment of the present invention. For the sake of simplicity, a print head 36*a* having the same arrangement of six nozzle rows, with nine nozzles per row, is used herein instead of the print head 36 having 48 nozzles in each of its six nozzle rows. The circles on the print head 36*a* indicate nozzle positions. The nozzles are divided into groups, and the numeral inside each circle indicates the number of the group to which the nozzle belongs. For example, nozzle Nos. 3, 6, and 9 of the dark yellow ink nozzle array $Y_D$ belong to the first group.

The plurality of nozzles on the print head 36*a* are divided into groups for the following reasons. The present embodiment operates on a principle whereby laser light L is blocked by ink drops ejected by the nozzles being tested, and luminous energy is reduced by such blockage. To make detection more reliable during the procedure in which the operating condition of a nozzle is confirmed, a method should be adopted in which ink drops ejected by other nozzles can be prevented from blocking the laser light L. An approach in which a plurality of nozzles are divided into groups, and each group is tested during separate main scans, is adopted in the present example as such a method.

A specific example will now be described on the assumption that a first group (the one with the numeral "1" in the circle) of nozzles is tested during a main scan. In this case, the first group of nozzles alone ejects ink drops. When the print head 36*a* moves in the direction of main scanning (MS), the laser light L is first blocked by the ink drops ejected by nozzle No. 9 in the dark yellow ink nozzle array $Y_D$. The laser light L reaches the area in which ink drops are ejected by nozzle Nos. 6 and 3 in the dark yellow ink nozzle array $Y_D$. In the process, the laser light L does not enter the areas in which ink drops are ejected by other nozzles of the first group.

Thus, dividing nozzles into groups in an appropriate manner makes it possible to set the nozzles under testing sufficiently far apart from each other, so when a nozzle is checked for operation, ink drops ejected by other nozzles are prevented from blocking laser light L.

The practicality of the first threshold t1, which is used to count forward the number of nozzles, should be taken into account in order to establish the manner in which the nozzles are divided into groups. The first threshold t1 is set at a level infallibly above the time ti between the detection pulses originating in the same nozzle but below the time tn between the detection pulses originating in different nozzles in order to allow the number of nozzles to be counted forward. Consequently, the interval between the nozzles being tested is made sufficiently wide to increase the time tn and to allow such a space to be present.

The practicality of the third threshold t3, which is used to count forward the number of nozzle rows, should also be taken into account in order to establish the manner in which the nozzles are divided into groups. The third threshold t3 is a value that serves as a basis for determining whether the laser light L has moved to another nozzle row when the measured time tm exceeds this value. The time tc needed for the light to switch from one nozzle row to another is proportional to the distance between the nozzle rows being tested, considering that the main scan speed remains constant. Consequently, a sufficiently wide interval should be established between the nozzle rows being tested such that the process can be tested using the third threshold t3 when the desired group division is established. In addition, the time tm actually measured by the timer is increased by the presence of missing dots in the above-described manner, and this fact should also be taken into account.

In the example shown in FIG. 11, the nozzle rows being tested comprise a dark yellow ink nozzle array $Y_D$, a dark magenta ink nozzle array $M_D$, and a dark cyan ink nozzle array $C_D$. When needed, however, the nozzle arrays being tested can be limited to a dark yellow ink nozzle array $Y_D$ and a dark cyan ink nozzle array $C_D$, further increasing the time tc.

Since each group is tested during a separate main scan, increasing the number of groups tends to increase the number of main scans for testing and to extend the testing time. Consequently, the number of groups should preferably be kept to a minimum while still being able to ensure reliable testing.

The angle between the laser light L and the nozzle rows is established with consideration for the following tradeoffs.

(1) Increasing the angle makes it possible to increase the number of nozzles that can be tested within a single nozzle row.

(2) Reducing the angle has the opposite effect from that achieved by increasing the angle. Specifically, a greater number of nozzle rows can be provided for testing, but the number of nozzles that can be tested within a single nozzle row is reduced. The selected setting should make it possible to maximize the number of nozzles tested during a single main scan.

The operation proceeds to step S105 (FIG. 8) when the procedure shown in FIG. 9 is completed. In step S105, the nozzle condition determiner 43 identifies the nozzle rows containing inoperative nozzles. This identification can be performed based on:

(1) the ordinal numbers of test nozzle rows which are specified by the number of nozzle rows obtained in step S210; and (2) the number of confirmed operative nozzles obtained in step S206 and the number of nozzles tested at respective nozzle row.

The presence of an inoperative nozzle region in a nozzle row is confirmed when the number of normally operative nozzles detected in step S206 is less than the number of nozzles being tested.

In step S105, the nozzle condition determiner 43 further identifies nozzle rows with inoperative nozzles by another method. The identification procedure is conducted based on a missing dot identification that indicates the presence of an inoperative nozzle region. The presence of an inoperative nozzle region is revealed by the fact that the time tm is greater than the second threshold t2 (step S207) but less than the third threshold t3 (step S208). The presence of inoperative nozzle rows can be determined by this procedure as well. The likelihood that missing dots will be overlooked can thus be reduced by calculating the logical sum of results provided by a method for comparing the numbers of nozzles and results provided by a direct method for detecting missing dots. In other words, the nozzle condition determiner 43 can detect the presence of inoperative nozzles once the presence of such nozzles is detected by at least one of the two methods.

FIGS. 12(*a*)-12(*c*) show tables with exemplary of test results. The results are compiled by collecting the detection results obtained during a plurality of main scans. The number of nozzles being tested is the total number of nozzles subject to testing. In the present example, all the nozzles provided to the print head 36*a* are subject to testing. In the tables, "black," "cyan," and the like refer to nozzle rows of the corresponding colors. The nozzle rows are identified based on the numerical count obtained in step S210 (FIG. 9) and on a predetermined detection sequence adopted for the nozzle rows.

FIG. 12(*a*) depicts theoretical results obtained using the detection method of the present embodiment in the absence of inoperative nozzles. As described above, it is assumed in this example that all the nozzles provided to the print head 36*a* are subject to testing, so each nozzle row contains nine test nozzles. There are nine confirmed normally operative nozzles in each nozzle row. An absence of inoperative nozzles can thus be confirmed because of a match between the number of nozzles detected by the ejected ink drops and the number of nozzles subject to testing.

Neither nozzle row has an inoperative nozzle region. This means that these nozzle rows are devoid of regions with inoperative nozzles. The presence or absence of inoperative nozzles can thus be confirmed by these two methods.

FIG. 12(*b*) depicts theoretical results obtained using the detection method of the present embodiment on the assumption that a single inoperative nozzle is found and that this nozzle is not an end nozzle of test nozzles in the black ink nozzle row (at the midpoint of black ink nozzle row). As used herein, the term "end nozzle" refers to a nozzle disposed as close as possible to the end portion of nozzles subject to testing in a nozzle row in the direction of sub-scanning. In the arrangement shown in FIG. 11, for example, nozzle Nos. 3 and 9 are the end nozzles of the first group of the dark yellow row, and nozzle Nos. 2 and 8 are the end nozzles of the third group of this nozzle row.

In the example shown in FIG. 12(*b*), the number of test nozzles in the black ink nozzle row is one less than the number of nozzles being tested. In addition, a single inoperative nozzle region is detected for the black nozzle row. A match is thus obtained due to the fact that, on one hand, the black nozzle row is found to contain a single inoperative nozzle and, on the other hand, a single region containing inoperative nozzles is found to exist.

FIG. 12(*c*) depicts theoretical results obtained using the detection method of the present embodiment on the assumption that the end nozzles of the cyan ink nozzle row contain one inoperative nozzle. This example is similar to the example shown in FIG. 12(*b*) in that the confirmed number of normally operative nozzles in the cyan ink nozzle row is one less than the number of nozzles being tested. No inoperative nozzle region is found to exist, however. It is thus found that the cyan ink nozzle row contains inoperative nozzles and that there are no inoperative nozzles among nozzles other than the end nozzles.

As described above, the presence of inoperative nozzles in a nozzle row can be detected when the number of test nozzles (number of nozzles confirmed to be operative normally) and the number of nozzles being tested are compared and the number of test nozzles is found to be less than the number of nozzles being tested. This approach is advantageous in that there is no need to align an ink drop detection device and a print head with high accuracy because the presence or absence of inoperative nozzles among the nozzles being tested can be confirmed without the use of information about the positional relation between the ink drop detection device and the print head.

In addition, inoperative nozzles can be directly tested in terms of the number of confirmed missing dots when the inoperative nozzles are not end nozzles. The present invention thus allows inoperative nozzles to be identified using two separate methods. Results can be double-checked by utilizing such an inoperative nozzle detection procedure and employing the first type of determination as part of a logical sum, thus reducing the possibility that inoperative nozzles will be overlooked when these nozzles are not end nozzles.

According to another preferred feature, the operation of end nozzles is analyzed before all the other nozzles are checked. The operation of the end nozzles is thus checked twice, making it possible to further increase detection accuracy. Normal operation of end nozzles can be confirmed by a method in which the end nozzles alone are caused to eject ink drops, these nozzles are then checked for operation, and a match is established between the number of end nozzles and the accumulated results.

D. Second Embodiment

Figure 13:
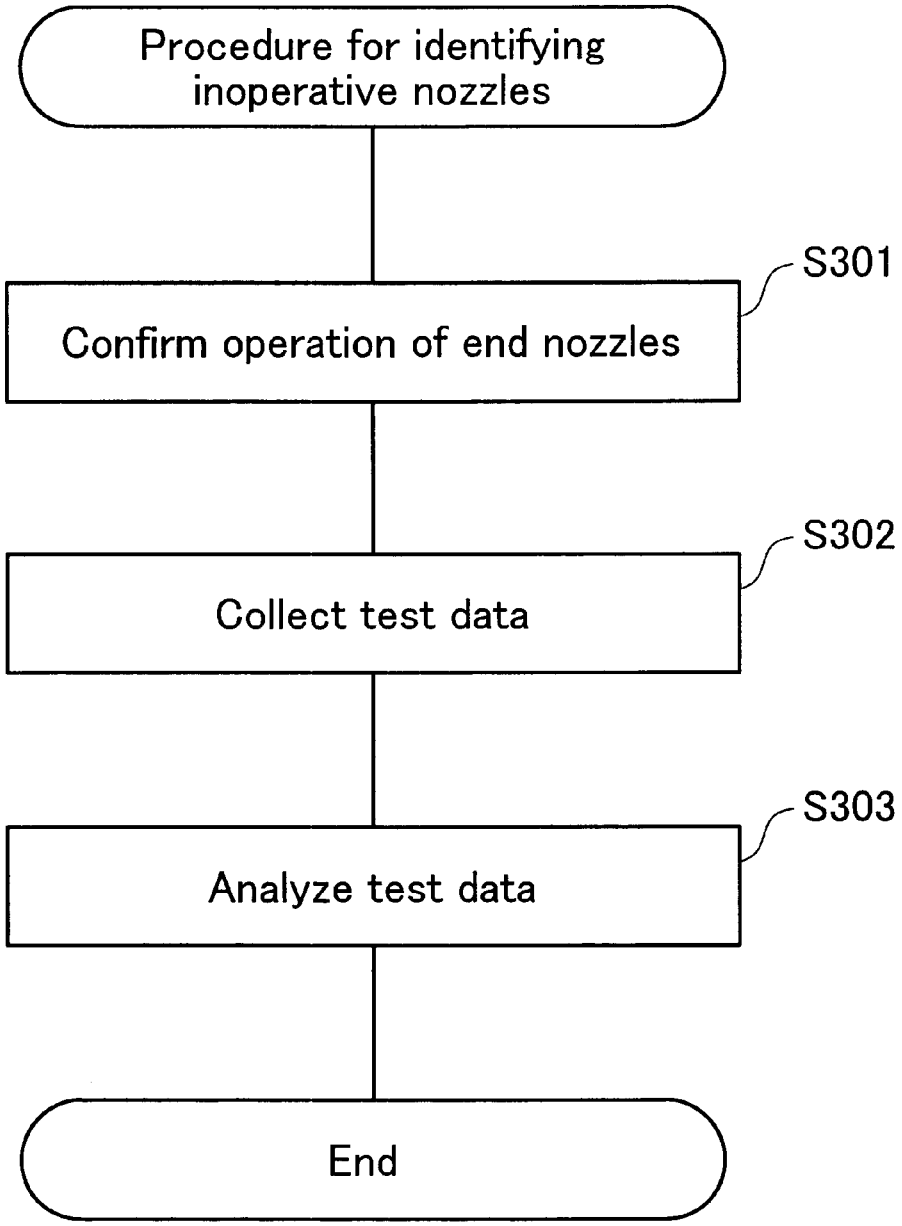
FIG. 13 is a flowchart depicting a procedure for identifying inoperative nozzles in terms of individual nozzles.

FIG. 13 is a flowchart depicting a procedure for identifying inoperative nozzles in terms of individual nozzles. Identifying inoperative nozzles may, for example, be advantageous in the sense that the dots originally intended to be formed by the inoperative nozzles can be complimented by other nozzles. The complementing operation will be omitted from the description given herein because this operation is described in detail in JP 2000-263772A, which is an application previously filed by the present applicant.

Step S301 entails confirming the operation of at least one end nozzle selected from among the test nozzles of each nozzle row. Following is a description of the reasons that such end nozzles are initially checked for operation.

The location of an inoperative nozzle is determined in the following manner. Let us assume, for example, that 50 nozzles are tested in a nozzle row during a single main scan and that at least one of the end nozzles, which are the initially checked nozzles, are checked for operation by the below-described method. A nozzle whose operation is thus checked is considered to be a reference nozzle. In this case, the presence of an inoperative nozzle region is detected following the detection of 24 normally operative nozzles (including the reference nozzle) during a testing procedure, assuming that the missing dots are generated by the 25th nozzle. As a result, it can be determined that the inoperative nozzle region starts from the 25th nozzle.

In step S302, the missing dot sensor 40 performs the same testing procedure as in the embodiment described above, and detection data are collected. In the second embodiment, however, information about inoperative nozzle regions is accumulated together with information about the number of normally operative nozzles detected before and after the procedure. In step S303, the detection data are analyzed and the positions of inoperative nozzles are identified. The identification procedure is performed during each main scan.

FIGS. 14(*a*)-14(*c*) contain tables with examples of results obtained by accumulating test cycles in accordance with the second embodiment of the present invention. The tables show results obtained by sampling data related to a single nozzle row. In these examples, the number of nozzles tested during a single main scan is 50. Missing dots are detected in the same manner as in steps S207 and S208 (FIG. 9). The term "number of nozzles detected before identification of missing dots" used in FIGS. 14(*a*)-14(*c*) refers to the number of nozzles counted before any missing dots are detected. The term "Number of nozzles detected after identification of missing dots" refers to the number of normally operative nozzles counted starting from the detection of missing dots all the way to the last nozzle of the nozzle row.

FIG. 14(*a*) depicts a table containing accumulated results obtained on the assumption that nozzle No. 22 is inoperative. In this example, the existence of a single region containing inoperative nozzles has been detected and 49 nozzles have already been proven as operating normally, so the operation of 50 nozzles is analyzed. Since the number of nozzles being tested is 50, it can be seen that all the nozzles being tested can be checked for operation.

The number of nozzles being tested is 50, the existence of a single region containing inoperative nozzles is detected, and 49 nozzles are found to be operating normally, making it possible to conclude that all the end nozzles operate normally by taking into account that the inoperative nozzles identifiable by missing dot identification cannot be end nozzles.

As shown in FIG. 14(*a*), 21 nozzles have been found to operate normally before the first instance of missing dots is discovered, and all the end nozzles have been proven to operate normally, making it possible to conclude that the inoperative nozzle region starts at nozzle No. 22. It can also be seen that only one nozzle is inoperative because the difference between the number of nozzles being tested and the number of confirmed normally operative nozzles is equal to one. It is thus possible to conclude that nozzle No. 22 alone is inoperative. Thus, the second embodiment allows inoperative nozzle positions to be determined nozzle by nozzle.

When one of the end nozzles produces missing dots, creating a situation different from the one presented in the above example, the missing dot identification procedure is useless for determining which of the end nozzles has produced the missing dots. This is because missing dots remain undetected when they are produced by an end nozzle. It is therefore preferable to use one of the end nozzles of a row as the reference nozzle and to confirm its operating status as a separate step. This is the reason that the operating status of end nozzles is first confirmed in step S301 (FIG. 13).

The operating status of nozzle No. 1 (reference nozzle) cannot be confirmed, and direct detection of the missing dots produced by nozzle No. 1 is impossible when such dots are produced. For this reason, nozzle No. 2 is the first nozzle analyzed by the detection device of the present embodiment. As a result, there is a risk that nozzle No. 24 will be identified as the nozzle with missing dots even though it is nozzle No. 25 that actually causes the missing dots.

The operating status of a reference nozzle can be confirmed by performing a testing operation in which at least one end nozzle of each nozzle row is allowed to eject ink drops while the other nozzles are prevented from doing so. As a result of this testing operation, a comparison is made between the number of confirmed normally operative nozzles and the number of reference nozzles from which ink drops are ejected, and the operating status of all the reference nozzles being tested is confirmed if a match is achieved. In the particular example of six nozzle rows, the operating status thereof can be confirmed if ink drops are ejected solely from six reference nozzles, and six nozzles are detected as a result of a testing operation. Nozzle cleaning may be scheduled when a reference nozzle produces missing dots. It is also possible to adopt an approach in which nozzles other than the end nozzles (whose operating status is confirmed by the above-described method) are used as reference nozzles, and positions of other inoperative nozzles are specified.

With this approach, the operating status of one of the end nozzles should preferably be confirmed because the position of the end nozzle cannot be identified even when it is inoperative. A method performed without confirming the operating status of end nozzles can also be used to set up a sequence in which cleaning is carried out when the position of an inoperative nozzle cannot be identified. Such a method dispenses with the need to directly confirm the operating status of reference nozzles, and is thus highly advantageous for use when end nozzles constitute a high proportion of all nozzles.

FIG. 14(*b*) depicts a table containing accumulated results obtained on the assumption that three nonconsecutive nozzles produce missing dots. In this example, three inoperative nozzles are detected and 47 nozzles are tested, making it possible to determine the operating status of 50 nozzles. It can thus be seen that the operating status of all test nozzles can be determined in this example as well.

The number of inoperative nozzles can first be determined in the above-described manner by subtracting the detected number of normally operating nozzles from the number of nozzles being tested. The present example has three such nozzles. The number of inoperative nozzle regions is also equal to three. As a result, it can be seen that each inoperative nozzle region contains one inoperative nozzle.

The positions of inoperative nozzle regions are then specified. Twenty-one nozzles are detected prior to the first inoperative nozzle region. Since it was learned that each inoperative nozzle region contained one inoperative nozzles, is possible to conclude that it was nozzle No. 22 that produced the missing dots. Similarly, 32 normally operating nozzles and one inoperative nozzle are identified prior to the second inoperative nozzle region, making it possible to conclude that it is nozzle No. 34 that produces the missing dots. The fact that nozzle No. 41 produces missing dots can be established in the same manner.

Thus, the present embodiment is configured such that the positions of multiple inoperative nozzles can be identified in the absence of situations in which a single inoperative nozzle region contains a plurality of inoperative nozzles. Determining the number of the inoperative nozzles allows the position of the inoperative nozzle on the print head 36 to be determined based on the information about the location of the main scan during which the determination was made and the information about the nozzle tested during this main scan.

FIG. 14(*c*) depicts a table containing accumulated results obtained on the assumption that two consecutive nozzles produce missing dots. This arrangement yields the same results as those obtained when missing dots are produced by nozzle No. 22 or 23 and by an end nozzle whose operating status cannot be confirmed. Thus, there are cases in which the position of an inoperative nozzle cannot be identified unless a direct conformation is provided for the operating status of an end nozzle.

An advantage of the above-described method is that the positions of inoperative nozzles can be specified nozzle by nozzle, making it possible to use other nozzles to complement dots initially scheduled to be formed by an inoperative nozzle.

The detection method of the present embodiment sometimes fails to identify inoperative nozzles when a single inoperative nozzle region contains a plurality of inoperative nozzles, as described above. It should be noted, however, that the presence of inoperative nozzles in a continuous nozzle array under testing often produces missing dots, taking into account the large number of nozzles being tested. Nozzle cleaning is recommended in such cases.

The detection method of the present invention thus allows inoperative nozzles whose number is sufficiently small for efficient management by a complementary procedure to be identified nozzle by nozzle while dispensing with the need to align the ink drop detection device and the print head nozzles with high accuracy.

E. Modifications

The present invention is not limited to the above-described embodiments or embodiments and can be implemented in a variety of ways as long as the essence thereof is not compromised. For example, the following modifications are possible.

(1) Although the above embodiments were described with reference to a case in which missing dots were detected at the same time as measurements were made during a main scan, there is no need to detect missing dots at the same time as the measurements are made. It is possible, for example, to adopt an arrangement in which digital data measured with a given sampling cyclicity (for example, 1 $\mu$s) are stored in memory or another storage element, and the presence of missing dots is detected by analyzing these data. The timing can be changed to allow missing dots to be detected during each main scan or after all the measurements are completed.

(2) In the above embodiments, software can be used to perform some of the hardware functions, or, conversely, hardware can be used to perform some of the software functions.

(3) The present invention can commonly be adapted to printing apparatus of the type in which ink drops are ejected, and can also be adapted to a variety of printing apparatus other than color ink-jet printers. For example, the present invention can be adapted to an inkjet facsimile machine or copying machine.

(4) Although the print heads of the above embodiments were provided with a plurality of nozzle rows aligned in the direction of main scanning, aligning the rows in the direction of sub-scanning is also a viable option.

Although the present invention has been described and illustrated in detail, it is clearly understood that the same is by way of illustration and example only and is not to be taken by way of limitation, the spirit and scope of the present invention being limited only by the terms of the append claims.

What is claimed is:

1. A printing apparatus, comprising:

a print head including a nozzle row having a plurality of nozzles for ejecting ink drops, the plurality of nozzles being aligned in a direction of sub-scanning;

an ink drop detector having a light emitter for emitting light and a light receiver for receiving the light emitted by the light emitter, the ink drop detector being configured to generate detection pulses in response to blockage of the light by the ink drops;

a feed mechanism configured to move the print head and/or the ink drop detector in order for the print head and the ink drop detector to move relative to each other;

a detection pulse analyzer capable of:

(i) measuring a time interval of two consecutive detection pulses which are detected by the ink drop detector while the print head and the ink drop detector are relatively moving in a constant speed;

(ii) judging that the two consecutive detection pulses are associated with a same nozzle if the time interval is less than a first threshold value, while judging that the two consecutive detection pulses are associated with two different nozzles if the time interval is greater than the first threshold value; and (iii) counting a number of operative nozzles capable of ejecting ink drops based on the judgment; and a nozzle condition determiner configured to determine presence of an inoperative nozzle incapable of ejecting ink drops if the number of operative nozzles is less than a number of test nozzles being subject to the ink drop detection.

2. The printing apparatus in accordance with claim 1, wherein the detection pulse analyzer judges that a missing dot region including at least one inoperative nozzle exists between the two different nozzles associated with the two consecutive detection pulses if the time interval is greater than a second threshold value which is greater than the first threshold value; and the nozzle condition determiner further determines presence of an inoperative nozzle based on the judgment of the missing dot region.

3. The printing apparatus in accordance with claim 2, wherein the print head comprises a plurality of test nozzle rows, the test nozzle rows being subject to the ink drop detection during a single pass of relative movement of the print head and the ink drop detector;

the detection pulse analyzer is capable of:

(i) judging that the two consecutive detection pulses are associated with two different test nozzle rows if the time interval is greater than a third threshold which is greater than the second threshold value;

(ii) counting a number of test nozzle rows based on the judgment of test nozzle row;

(iii) counting a number of operative nozzles in each test nozzle row; and (iv) counting a number of missing dot regions in each test nozzle row; and the nozzle condition determiner further determines presence of an inoperative nozzle in an individual test nozzle row if the number of operative nozzles in the test nozzle row is less than the number of test nozzles in the test nozzle row and/or if the missing dot region is detected in the test nozzle row.

4. The printing apparatus in accordance with claim 2, wherein the detection pulse analyzer counts a number of operative nozzles and a number of missing dot regions which are present before each missing dot region; and the nozzle condition determiner determines a position of each inoperative nozzle included in each missing dot region based on the number of operative nozzles and the number of missing dot regions present before each missing dot regions.

5. The printing apparatus in accordance with claim 2, wherein the detection pulse analyzer counts a number of operative nozzles and a number of missing dot regions which are present after each missing dot region; and the nozzle condition determiner determines a position of each inoperative nozzle included in each missing dot region based on the number of operative nozzles and the number of missing dot regions present after each missing dot regions.

6. The printing apparatus in accordance with claim 2, wherein the detection pulse analyzer counts a number of operative nozzles and a number of missing dot regions which are present before and after each missing dot region; and the nozzle condition determiner determines a position of each inoperative nozzle included in each missing dot region based on the number of operative nozzles and the number of missing dot regions present before and after each missing dot regions.

7. The printing apparatus in accordance with claim 2, wherein the detection pulse analyzer is further capable of:

(i) counting a number of operative reference nozzles which are disposed at one of ends of each test nozzle row based on detection signals obtained while only the reference nozzles are ejecting ink drops; and (ii) counting a number of operative intermediate nozzles and a number of intermediate missing dot regions, the operative intermediate nozzles and the intermediate missing dot regions being disposed between the reference nozzle and each missing dot regions in each test nozzle rows; and the nozzle condition determiner is further capable of:

(i) determining that all of the reference nozzles are operative nozzles if the number of operative reference nozzles matches a number of the reference nozzles; and (ii) determining a position of each inoperative nozzle included in each missing dot region in each test nozzle row based on the number of operative intermediate nozzles and the number of intermediate missing dot regions in each test nozzle rows.

8. The printing apparatus in accordance with claim 1, wherein the feed mechanism is capable of moving the print head and/or the ink drop detector in order for the print head and the ink drop detector to move relative to each other a plurality of times;

the plurality of nozzles are divided into a plurality of groups, a selected one of the plurality of groups being subject to testing during one pass of relative movement;

the detection pulse analyzer counts a number of operative nozzles during each pass of relative movement; and the nozzle condition determiner determines presence of an inoperative nozzle incapable of ejecting ink drops if the number of operative nozzles is less than a number of the test nozzles during each pass of relative movement.

9. The printing apparatus in accordance with claim 1, wherein the print head comprises a plurality of test nozzle rows, the test nozzle rows being subject to the ink drop detection during a single pass of relative movement of the print head and the ink drop detector;

the detection pulse analyzer is capable of:

(i) judging that the two consecutive detection pulses are associated with two different test nozzle rows if the time interval is greater than a third threshold which is greater than the second threshold value;

(ii) counting a number of test nozzle rows based on the judgment of test nozzle row; and (iii) counting a number of operative nozzles in each test nozzle row; and the nozzle condition determiner further determines presence of an inoperative nozzle in an individual test nozzle row if the number of operative nozzles in the test nozzle row is less than the number of test nozzles in the test nozzle row.

10. The printing apparatus in accordance with claim 1, wherein the detection pulse analyzer counts a number of operative reference nozzles which are disposed at one of ends of each test nozzle row based on detection signals obtained while only the reference nozzles are ejecting ink drops; and the nozzle condition determiner further determines that all of the reference nozzles are operative nozzles if the number of operative reference nozzles matches a number of the reference nozzles.

11. A method for testing ejections of ink by a print head including a nozzle row having a plurality of nozzles for ejecting ink drops, the plurality of nozzles being aligned in a direction of sub-scanning, the method comprising:

(a) generating light in a direction across paths of ink drops ejected from at least some of a plurality of nozzles subject to testing, while moving the print head and/or the light relative to each other at a constant speed;

(b) generating detection pulses in response to blockage of the light by the ink drops;

(c) measuring a time interval of two consecutive detection pulses which are detected by the ink drop detector while the print head and the ink drop detector are relatively moving in a constant speed;

(d) judging that the two consecutive detection pulses are associated with a same nozzle if the time interval is less than a first threshold value, while judging that the two consecutive detection pulses are associated with two different nozzles if the time interval is greater than the first threshold value;

(e) counting a number of operative nozzles capable of ejecting ink drops based on the judgment; and (f) determining presence of an inoperative nozzle incapable of ejecting ink drops if the number of operative nozzles is less than a number of test nozzles being subject to the ink drop detection.

12. The method in accordance with claim 11, wherein the step (d) includes the step of judging that a missing dot region including at least one inoperative nozzle exists between the two different nozzles associated with the two consecutive detection pulses if the time interval is greater than a second threshold value which is greater than the first threshold value; and the step (f) includes the step of determining presence of an inoperative nozzle based on the judgment of the missing dot region.

13. The method in accordance with claim 12, wherein the print head comprises a plurality of test nozzle rows, the test nozzle rows being rows of nozzles subject to the ink drop detection during a single pass of relative movement of the print head and the ink drop detector;

the step (d) includes the step of judging that the two consecutive detection pulses are associated with two different test nozzle rows if the time interval is greater than a third threshold which is greater than the second threshold value;

the step (e) includes the steps of:

counting a number of test nozzle rows based on the judgment of test nozzle row;

counting a number of operative nozzles of each test nozzle row; and counting a number of missing dot regions in each test nozzle row; and the step (f) includes the step of determining presence of an inoperative nozzle in an individual test nozzle row if the number of operative nozzles in the test nozzle row is less than the number of test nozzles in the test nozzle row and/or if the missing dot region is detected in the test nozzle row.

14. The method in accordance with claim 12, wherein the step (e) includes the step of counting a number of operative nozzles and a number of missing dot regions which are present before each missing dot region; and the step (f) includes the step of determining a position of each inoperative nozzle included in each missing dot region based on the number of operative nozzles and the number of missing dot regions present before each missing dot regions.

15. The method in accordance with claim 12, wherein the step (e) includes the step of counting a number of operative nozzles and a number of missing dot regions which are present after each missing dot region; and the step (f) includes the step of determining a position of each inoperative nozzle included in each missing dot region based on the number of operative nozzles and the number of missing dot regions present after each missing dot regions.

16. The method in accordance with claim 12, wherein the step (e) includes the step of counting a number of operative nozzles and a number of missing dot regions which are present before and after each missing dot region; and the step (f) includes the step of determining a position of each inoperative nozzle included in each missing dot region based on the number of operative nozzles and the number of missing dot regions present before and after each missing dot regions.

17. The method in accordance with claim 12, wherein the step (e) includes the steps of:

counting a number of operative reference nozzles which are disposed at one of ends of each test nozzle row based on detection signals obtained while only the reference nozzles are ejecting ink drops; and counting a number of operative intermediate nozzles and a number of intermediate missing dot regions, the operative intermediate nozzles and the intermediate missing dot regions being disposed between the reference nozzle and each missing dot regions in each test nozzle rows; and the step (f) includes the steps of:

determining that all of the reference nozzles are operative nozzles if the number of operative reference nozzles matches a number of the reference nozzles; and determining a position of each inoperative nozzle included in each missing dot region in each test nozzle row based on the number of operative intermediate nozzles and the number of intermediate missing dot regions in each test nozzle rows.

18. The method in accordance with claim 11, wherein the step (a) includes the step of moving the print head and/or the ink drop detector in order for the print head and the ink drop detector to move relative to each other a plurality of times;

the method further comprises the step of dividing the plurality of nozzles into a plurality of groups, a selected one of the plurality of groups being subject to testing during one pass of relative movement;

the step (e) includes the step of counting a number of operative nozzles during each pass of relative movement; and the step (f) includes the step of determining presence of an inoperative nozzle incapable of ejecting ink drops if the number of operative nozzles is less than a number of the test nozzles during each pass of relative movement.

19. The method in accordance with claim 11, wherein the print head comprises a plurality of test nozzle rows, the test nozzle rows being subject to the ink drop detection during a single pass of relative movement of the print head and the ink drop detector;

the step (d) includes the step of judging that the two consecutive detection pulses are associated with two different test nozzle rows if the time interval is greater than a third threshold which is greater than the second threshold value;

the step (e) includes the steps of:

counting a number of test nozzle rows based on the judgment of test nozzle row; and counting a number of operative nozzles in each test nozzle row; and the step (f) includes the step of determining presence of an inoperative nozzle in an individual test nozzle row if the number of operative nozzles in the test nozzle row is less than the number of test nozzles in the test nozzle row.

20. The method in accordance with claim 11, wherein the step (e) includes the step of counting a number of operative reference nozzles which are disposed at one of ends of each test nozzle row based on detection signals obtained while only the reference nozzles are ejecting ink drops; and the step (f) includes the step of determining that all of the reference nozzles are operative nozzles if the number of operative reference nozzles matches a number of the reference nozzles.

21. A computer program product for causing a computer to test ejections of ink by a print head including a nozzle row having a plurality of nozzles for ejecting ink drops, the plurality of nozzles being aligned in a direction of sub-scanning, the computer program product comprising:

a computer readable medium; and a computer program stored on the computer readable medium, the computer program comprising:

a first program for causing the computer to control a generation of light in a direction across paths of ink drops ejected from at least some of a plurality of nozzles subject to testing, while moving the print head and/or the light relative to each other at a constant speed;

a second program for causing the computer to control a generation of detection pulses in response to blockage of the light by the ink drops;

a third program for causing the computer to measure a time interval of two consecutive detection pulses which are detected by the ink drop detector while the print head and the ink drop detector are relatively moving in a constant speed;

a fourth program for causing the computer to judge that the two consecutive detection pulses are associated with a same nozzle if the time interval is less than a first threshold value, while judging that the two consecutive detection pulses are associated with two different nozzles if the time interval is greater than the first threshold value;

a fifth program for causing the computer to a number of operative nozzles capable of ejecting ink drops based on the judgment; and a sixth program for causing the computer to determine presence of an inoperative nozzle incapable of ejecting ink drops if the number of operative nozzles is less than a number of test nozzles being subject to the ink drop detection.

* * * * *